US006695031B1

(12) United States Patent
Baltensperger

(10) Patent No.: US 6,695,031 B1
(45) Date of Patent: Feb. 24, 2004

(54) ADHESIVE APPLICATION STATION FOR PRINTED PRODUCTS

(75) Inventor: Walter Baltensperger, Baar (CH)

(73) Assignee: Sogno AG, Baar (CH)

( * ) Notice: Subject to any disclaimer, the term of this patent is extended or adjusted under 35 U.S.C. 154(b) by 0 days.

(21) Appl. No.: 09/913,662

(22) PCT Filed: Feb. 25, 2000

(86) PCT No.: PCT/CH00/00105

§ 371 (c)(1),
(2), (4) Date: Aug. 17, 2001

(87) PCT Pub. No.: WO00/51826

PCT Pub. Date: Sep. 8, 2000

(30) Foreign Application Priority Data

Mar. 1, 1999 (EP) ..... 99810173

(51) Int. Cl.[7] ..... B42B 5/00

(52) U.S. Cl. ..... 156/556; 156/578; 156/908; 412/33; 412/37

(58) Field of Search ..... 156/908, 556, 156/578; 412/37, 33

(56) References Cited

U.S. PATENT DOCUMENTS 4,512,945 A * 4/1985 Vigano ..... 264/263
5,418,009 A * 5/1995 Raterman et al. ..... 427/207.1
6,474,391 B1 * 11/2002 Schmidt ..... 156/556

FOREIGN PATENT DOCUMENTS

EP 0 550 913 7/1993

* cited by examiner

*Primary Examiner*—Jeff H. Aftergut
*Assistant Examiner*—Todd J. Kikenny
(74) *Attorney, Agent, or Firm*—Bachman & LaPointe, P.C.

(57) ABSTRACT

The invention relates to an adhesive application station provided for bonding stacked printed products using a flowable or liquifiable adhesive. The inventive station comprises an application head which is provided for the adhesive and which has a sliding surface for the printed products. The station also comprises a stop which is arranged on each side of said sliding surface and which is provided for the printed products, and comprises a slotted nozzle which is provided for the adhesive and which extends over the entire width of the sliding surface. The adhesive application station also has an adhesive reservoir that is configured as a pressure chamber and has means for generating pressure in said adhesive reservoir. At least one lateral stop is configured as a lateral guide surface which, within a narrow tolerance zone, automatically compensates for different thicknesses of the stacked printed products that are passing through. A stop which can be moved in this tolerance zone such that it can be returned always rests closely on a delivery slot of the slotted nozzle in the sliding surface.

10 Claims, 6 Drawing Sheets

ADHESIVE APPLICATION STATION FOR PRINTED PRODUCTS

Figure 1:
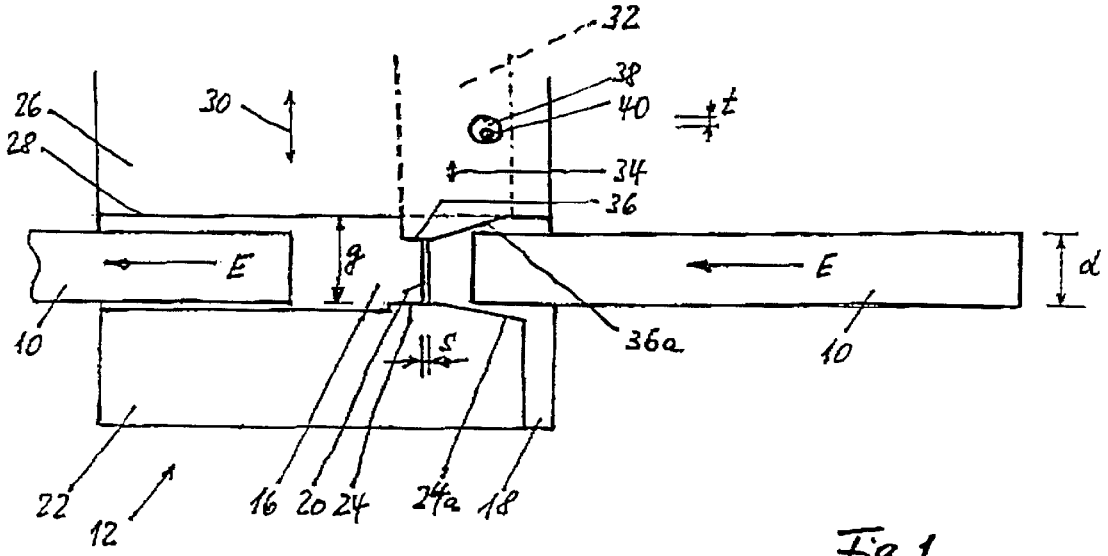

The invention concerns an adhesive application station for binding stacked printed products by means of a liquid or liquefiable adhesive, where the application station comprises an application head for the adhesive with a slip surface for the printed products, and on both sides of this slip surface a stop for these printed products and a slot nozzle extending over the entire width of the slip surface for the adhesive, an adhesive reservoir formed as a pressure chamber and means for generating a pressure in the adhesive reservoir.

For production of books, magazines, brochures etc. printed products of all types are first stacked and fixed in a holder. Then the so-called spine is milled flat and simultaneously roughened. In this way the subsequently applied adhesive can adhere better. Insufficient adhesion of the adhesive leads to poor binding quality, the bound printed products fall apart in use or individual leaves become detached. The applied adhesive layer must, however, not only firmly bind each individual page but also be sufficiently resilient to allow easy leaving through the bound printed products.

The application of adhesive with a brush or equivalent means as practised originally was simplified as developments advanced so that the prepared spine of a stack could be drawn over at least one roller immersed in an adhesive bath. However, this open system still has the disadvantage that, for example in the case of a moisture-reactive polyurethane adhesive, the physical and chemical properties could change under the effects of air and heat. The same or similar problems can occur in all known adhesives which are used as cold adhesives, hot adhesives or hot melts (thermoplastic adhesives). Advantageously, economical and ecological considerations have led for example to watery polyurethane dispersions, known in brief as PU dispersions. The term PU indicates a group of high molecular materials which are produced by poly-addition of di-isocyanates and bi- or multi-functional hydroxyl compounds. In their molecules the basic modules are linked by the urethane group (—NH—COO—). Depending on the chemical nature of the original compounds used, polyurethanes are obtained with linear, branched or cross-linked macro-molecules. Linear polyurethanes are thermoplastic substances which have multiple applications. Here we are interested only in cross-linked elastomer polyurethanes which are suitable as resilient, water- and heat-resistant adhesives.

Adhesive application stations are known which work with slot nozzles. The prepared spine of a stack of printed products is drawn between two stops over a slip surface with an outlet slot for the adhesive. The slot nozzle discharges adhesive during this short period. Although stacks with the same number of printed products are drawn through in succession, these stacks do not have precisely the same width. In special cases the different stack widths can deviate by up to ±1 mm. Even within one and the same stack, width differences of the order of a few tenths of millimeters can occur. In practice the result is recurrent problems, for example with adhesive strings on the bound printed product.

EP 0 550 913 A1 describes an adhesive application station with two jaws manually adaptable to various stack heights and forming the side guide jaws. For slightly different stack heights at least one screw must be adjusted or the play between the jaw and the stack taken into account. This leads to greater cost or the formation of unattractive adhesive strings. To eliminate this disadvantage a sealing block is inserted in each jaw.

The invention is therefore based on the task of creating an adhesive application station for binding stacked printed products of the type described initially which eliminates the problems with different stack widths.

The task is solved by the invention in that at least one side stop is formed as a side guide surface which automatically compensates within a narrow tolerance range for different thicknesses of the stacked printed products passing through, and a stop returnably movable within this tolerance range always lies tightly on an outlet slot of the slot nozzle for the adhesive in the slip surface. Special and further developments of the adhesive application station are the subject of dependent claims.

As a stack always contains the same number of printed products which are cut from the same print carrier web, the tolerance ranges are from experience very narrow. Even in large stacks they are normally maximum approximately ±0.5 mm, in exceptional cases maximum ±1 mm.

In practice the most economic solution is to form an application head with a fixed stop and a stop which is resilient within the tolerance range for the stacked printed products to be bound. The advance of the stack is preferably facilitated in that the guide surfaces in the insertion direction taper to the area of the slot nozzle. This can be achieved in the form of chamfers but also by suitably curved surfaces.

The stop which is resilient in the slot direction with a guide surface can be structured according to various variants irrespective of whether a fixed stop is formed or whether both stops are resilient:

According to a first variant, a guided carriage, resilient as a whole, can be moved on a nozzle block of the application head in the direction of the outlet slot and with its guide surface form a resilient stop.

In a further variant a suitably cylindrical roller movable in the slot direction in a positionable holder and with an axis perpendicular to the slip surface, can be the guide surface.

In a variant a slide guided in the slot direction is formed with a correspondingly shaped front guide surface. The slide is movable in the direction of the guide slot, for example against the resistance of a spring or against a pneumatic pressure, and arranged in a precisely positionable retainer.

According to a last variant mentioned here, a leaf spring is arranged at the front on a positionable holder already mentioned, so that it forms a guide surface deformable resiliently by approximately ±1 mm in the slot direction. Various types of leaf spring are suitable which simultaneously cover the outlet slot in the tolerance range of approximately ±1 mm.

As already indicated, the movable stop is automatically returnable preferably by spring force. In the same way the movable stop can be pneumatically sprung. As the necessary tolerance range as has been stated is very narrow, and usually only amounts to fractions of a millimeter, the movable stop must be positionable precisely.

Furthermore, the movable stop lying on the adhesive outlet slot must cover this so well that no adhesive strings form on the bound stack of printed products. As the stops with the side guide surfaces, except for the variant with a leaf spring, can be formed more or less solid, this is in principle no problem. A short insert or thickening in a late spring can also fulfil this purpose.

The slot nozzle is formed by co-operation between the adhesive outlet slot with a metering shaft arranged tightly immediately below which for example has a diagonal longitudinal through-slot. The metering shaft in turn borders an adhesive reservoir formed as a pressure chamber which is arranged in or below the application head and in direct connection with an adhesive dispenser, for example a pressure vessel. This has the advantage not previously achieved that the adhesive, from the pressure vessel to the outlet slot in the application head, never makes contact with the air, which prevents the chemical and physical changes mentioned initially.

To create the necessary pressure in the adhesive dispenser, in a preferred variant a direct action plunger of a pressure cylinder is provided in a pneumatic accumulator. The necessary pressure can, however, also be generated hydraulically, electromagnetically or with a spindle.

The pressure can be and is changed in relation to the machine speed.

For the use of a hot adhesive, in particular a hot melt, arranged in the adhesive reservoir is at least one heating cartridge which is suitably sensor-controlled. By means of a temperature sensor, the adhesive is held at the temperature necessary for optimum viscosity.

After each discharge of adhesive through the outlet slot, automatic pressure compensation, known in itself, takes place which is integrated in the system with the pneumatic accumulator.

All stops with the guide surfaces for the stack of printed products to be bound preferably consist of wear-resistant polished material as the print media drawn over these, in particular paper, acts as an abrasive cloth. Special steels, hard metals, ceramic materials or cermets are suitable materials for guide surfaces.

Figure 2:
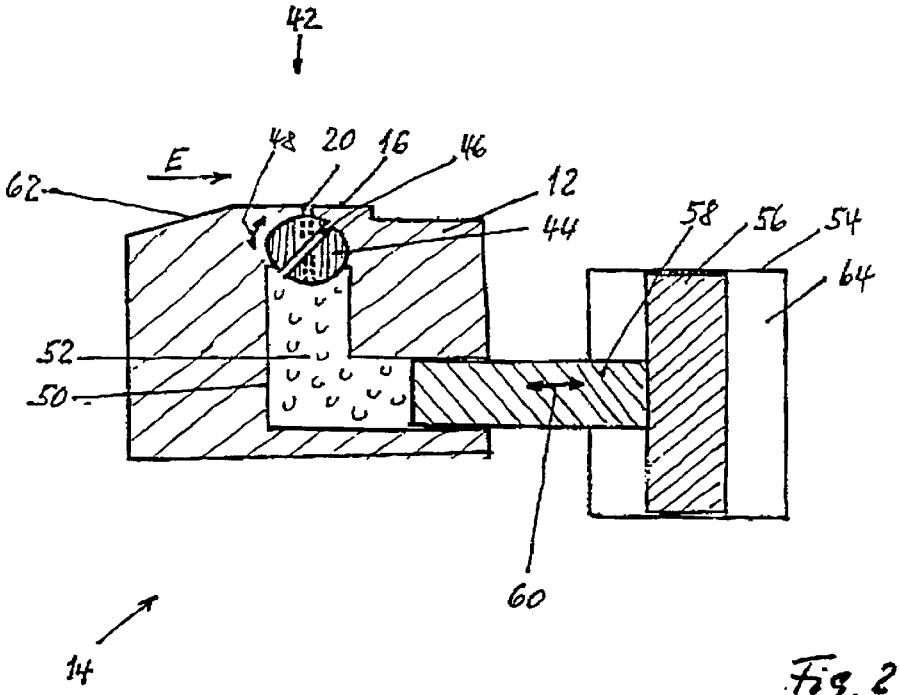
Figure 3:
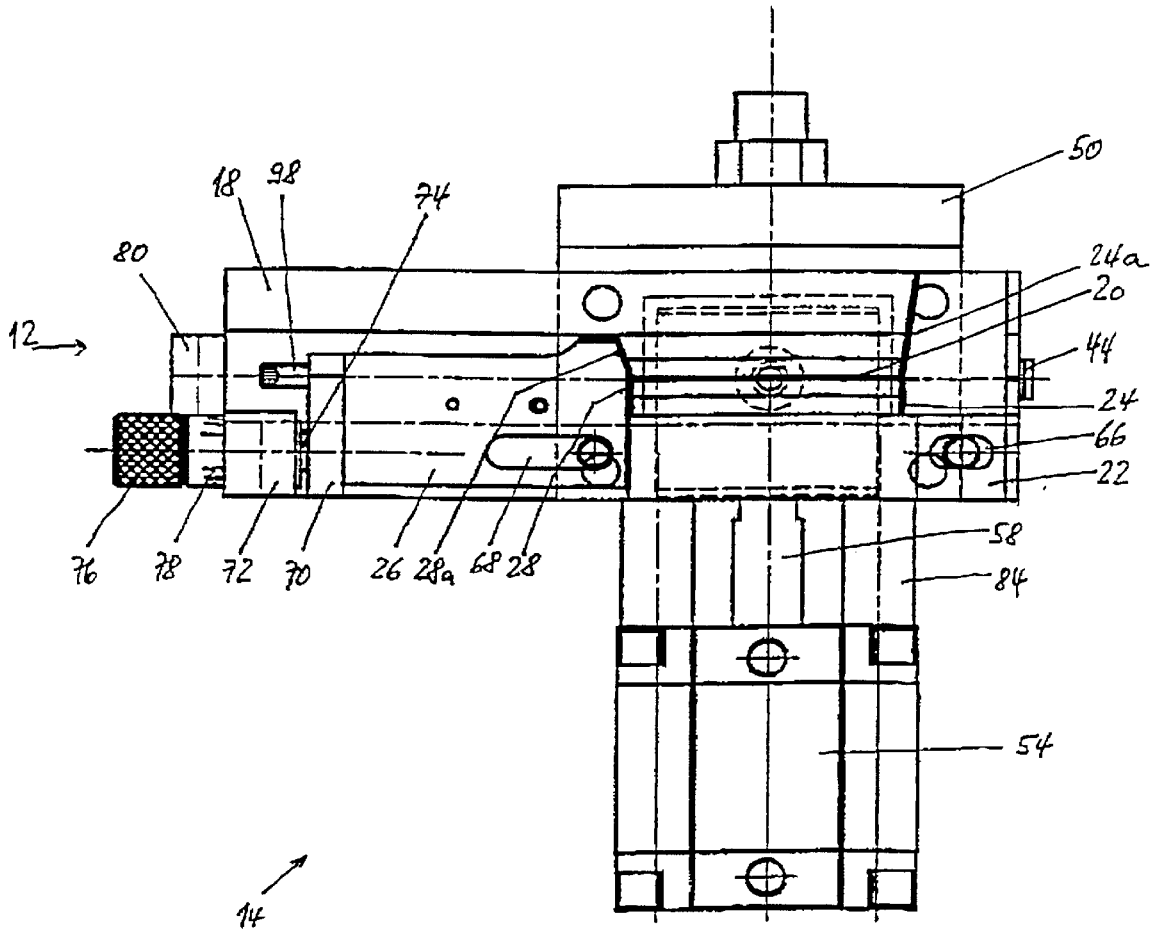
Figure 4:
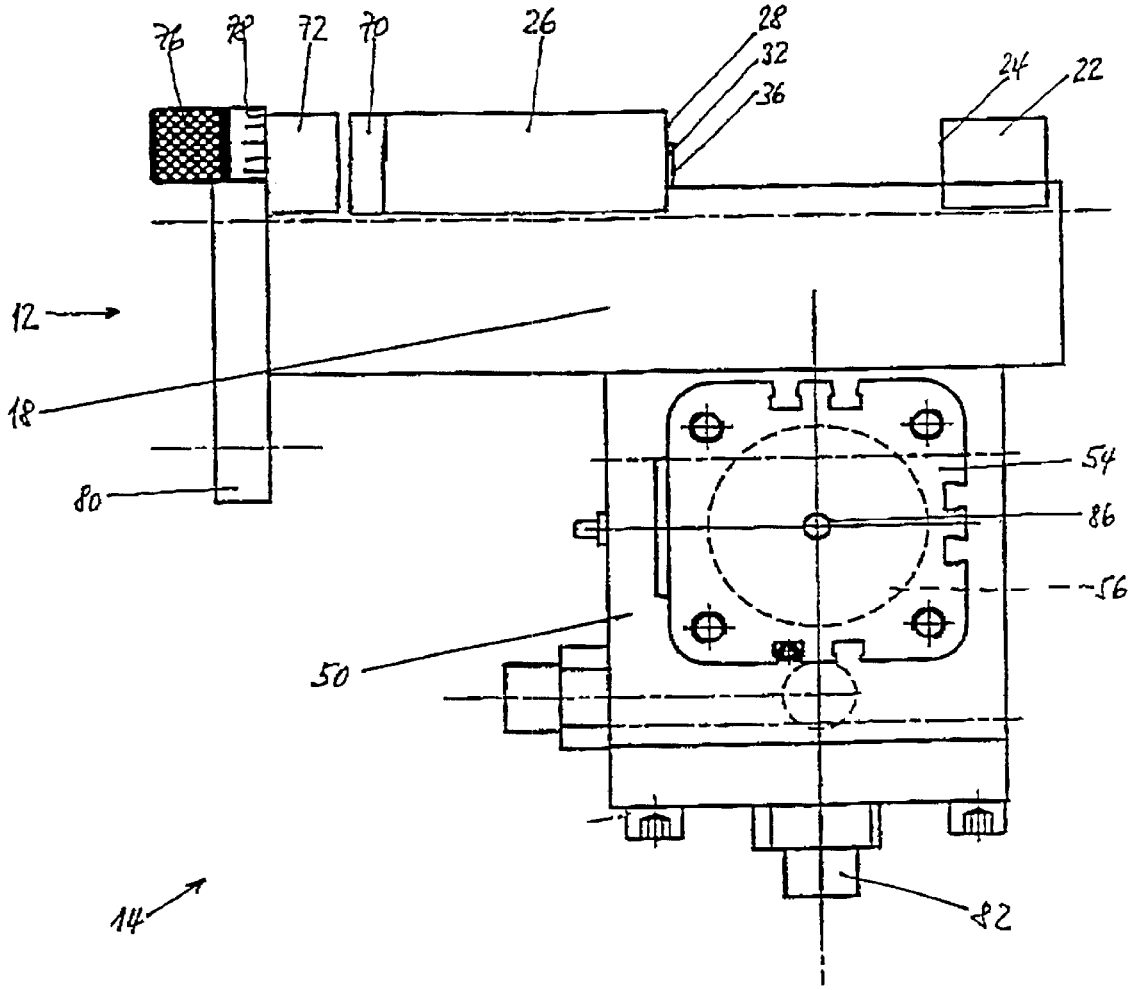
Figure 5:
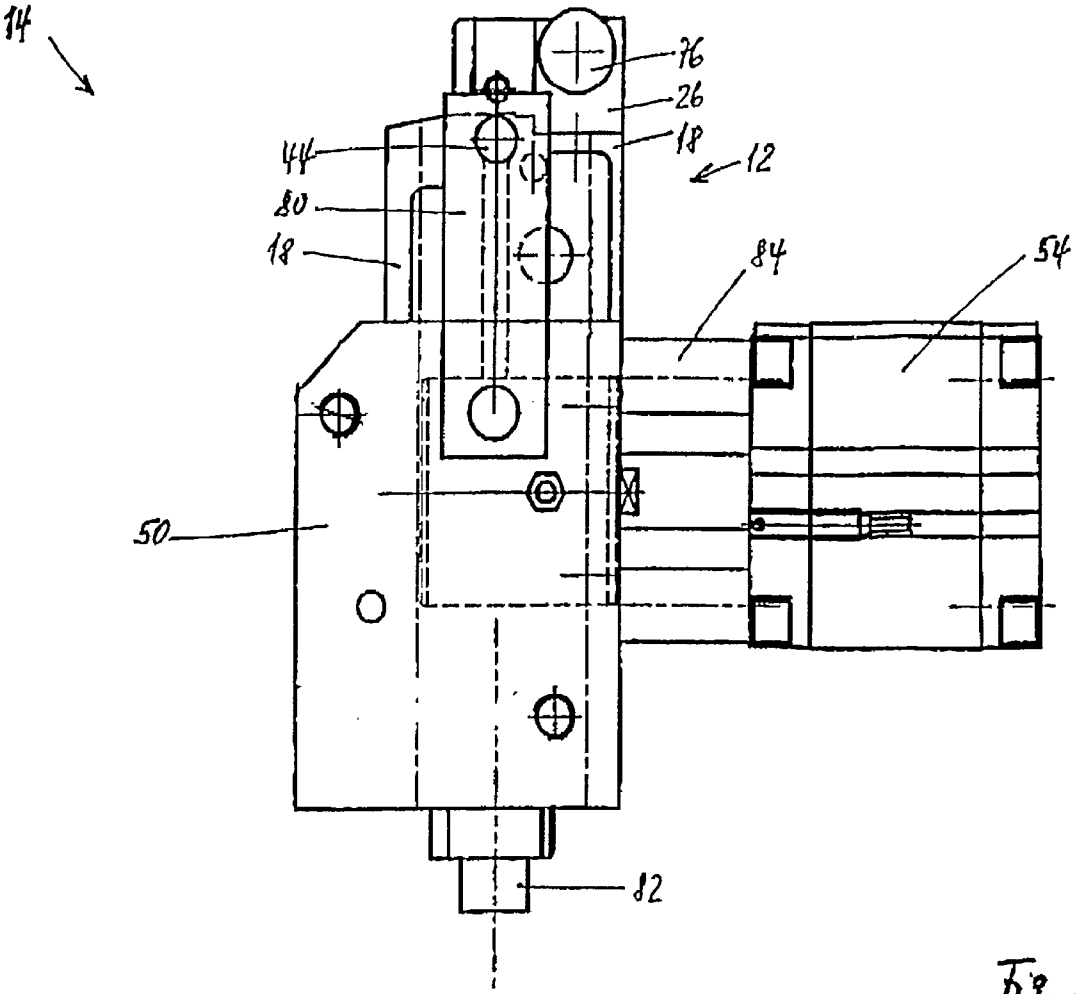
Figure 6:
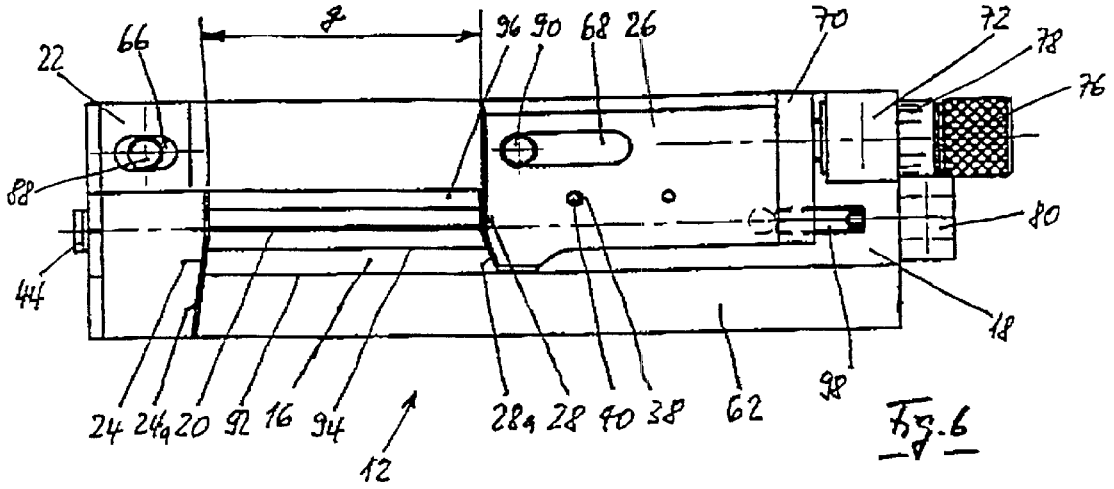
Figure 7:
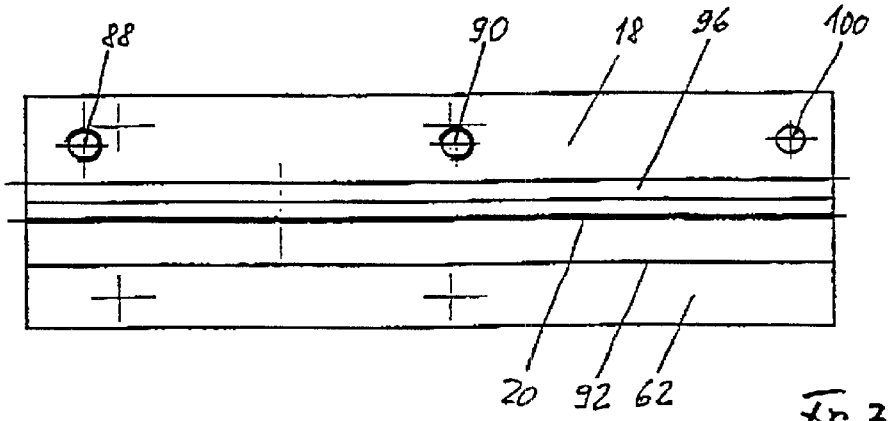
Figure 8:
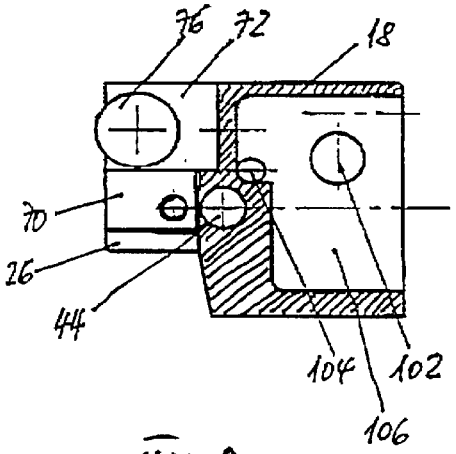
Figure 9:
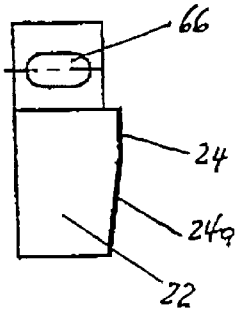
Figure 10:
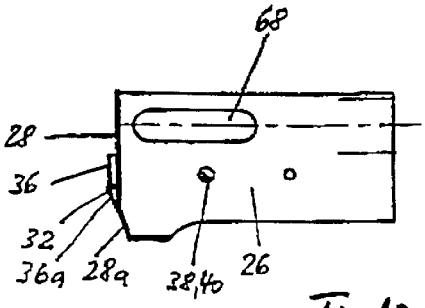
Figure 11:
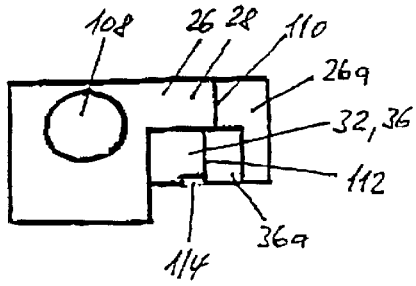

The invention is explained in more detail using the example embodiments shown in the drawing which are the subject of dependent claims. These show diagrammatically:

FIG. 1 a principle sketch of the binding area of an application head of an adhesive application system in a top view, FIG. 2 a principle sketch of a pressure system with pressure compensation in cross-section, FIG. 3 a top view onto an adhesive application station, FIG. 4 a front view of FIG. 3, FIG. 5 a side view of FIG. 3 (from the left), FIG. 6 an application head in top view, FIG. 7 a nozzle block of FIG. 6, FIG. 8 a side view of FIG. 6 (from the right), FIG. 9 a fixed stop, FIG. 10 a retainer in top view, FIG. 11 a side view of FIG. 10 (from the left)

Figure 12:
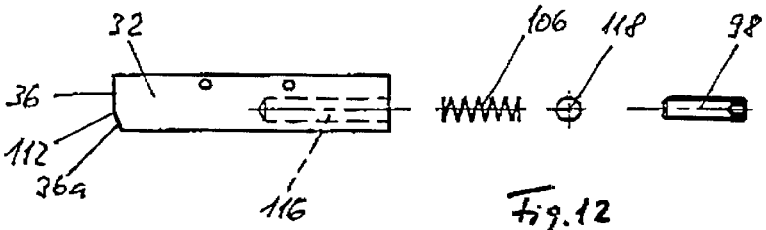
Figure 14:
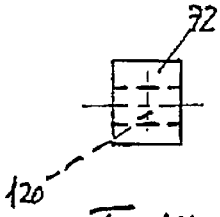
Figure 13:
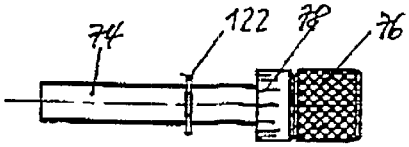

FIG. 12 a slider plate in top view, exploded,

FIG. 13 an adjustment screw for a retainer,

FIG. 14 a guide block for the adjustment screw, and

Figure 15:
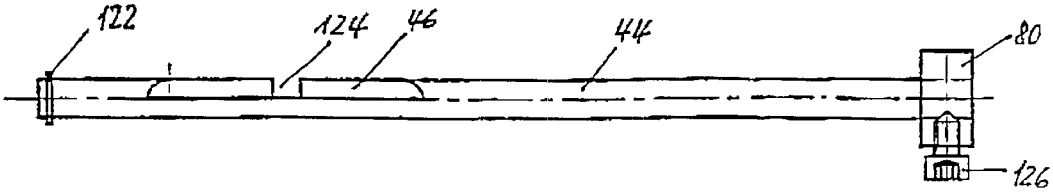

FIG. 15 a metering shaft.

FIG. 1 shows the basic principle of the binding of stacked printed products 10 on an application head 12 of an adhesive application station 14 (FIGS. 3 to 5). A slip surface 16 of a nozzle block 18 of the application head 12 has an outlet slot 20 running in the longitudinal direction for an adhesive 52 (FIG. 2). In the present case the slot width s of the outlet slot 20 is approximately 0.2 mm. This slot width is not normally modifiable, it can, however, also be adjustable.

The slip surface 16 is bordered at the side by a fixed stop 22 with a first guide surface 24, including a deflector 24*a*, and a retainer 26 with a second guide surface 28, including a deflector 28*a* for a printed product 10. The retainer 26 can be moved and positioned precisely in the direction of the double arrow 30 which runs parallel to the outlet slot 20. The retainer 26 guides a slide 32 which can be pressed into the retainer 26 against a spring force within a close tolerance range t in the direction of the double arrow 34 also running parallel to the outlet slot 20. The slide 32 has a third guide surface 36 for stacked printed products 10 also with a deflector 36*a*. Both this third guide surface 36 and the first guide surface 24 are angled and expand as deflectors 24*a*, 36*a* against the introduction device E for stacked printed products 10. The close tolerance range t for the slide 32 which can be returned by spring force is limited by a bore 38 in the retainer 26 and a bolt 40 projecting into this bore from the slide 32.

To bind stacked printed products, first the retainer 26 with slide 32 is positioned according to the minimum thickness d of the stacked printed products 10, and for example adjusted with a screw. For a tolerance range of for example 0.5 mm for the thickness d of the stacked printed products, the width g of the slip surface 16 is set at distance d+t, assuming that the slide 32 is pressed flush against the second guide surface 28 at maximum tolerance t. The slide 32 is pressed in when the stacked printed products 10 are introduced, when they are pushed along deflectors 24*a*, 36*a* of the first and third guide surfaces 24, 36. When reaching the outlet slot 20 the adhesive application begins mechanically, electronically or sensor-controlled and ends when the printed product 10 leaves the area of the outlet slot 20.

Both the retainer 26 and the slide 32 seal the outlet slot when and where they lie on the slip surface 16.

When the stacked printed products 10 are guided over the outlet slot 20, they are pressed by the slide 32 onto the first side guide surface 24. The second guide surface 28 does not in this case act as such, the stacked printed products 10 slide along the third guide surface 36 with deflector 36*a*. On binding according to FIG. 1, differences with regard to thickness d of the stacked printed products 10, both within the same stack and from stack to stack, are compensated automatically, adhesive cannot be discharged next to the printed products 10, thus avoiding not only a loss of adhesive but also the formation of undesirable adhesive strings.

According to a variant of the basic principle which is not shown, the slide 32 can be omitted and the retainer 26 itself formed as a movable stop resilient in the tolerance range. In this case the stacked printed products 10 slide along the second guide surface 28 with deflector.

The functional description of FIG. 1 is supplemented by FIG. 2 drawn from the opposite side. In the application head 12 is sketched a slot nozzle 42 which comprises the outlet slot 20 shown in FIG. 1 and a metering shaft 44 which is guided in a bore of the application head 12 and has a diagonal slot 46. This extends over the length of the outlet slot 20.

Below the metering shaft 44, which is rotatable in the direction of double arrow 48, is arranged an adhesive reservoir 50 formed as a pressure chamber which is filled with a dissolved or melted adhesive 52. Arranged in an accumulator 54 is a pressure cylinder 56 with a plunger 58 movable in the direction of double arrow 60 and which projects into the adhesive reservoir 50.

The pressure system 14 shown in FIG. 2 for adhesive application is in the center position. The diagonal slot 46 communicating with the adhesive is closed.

When stacked printed products 10 (FIG. 1) are guided along the slip surface 16 extending over an angled introduction ramp 62, the control of the metering shaft 44 on reaching the outlet slot 20 immediately switches into the working position shown in dotted lines, the diagonal slot 46 of the metering shaft 44 in this position connects the adhesive reservoir 50 with the outlet slot 20. Immediately after the stacked printed products 10 have left the area of the outlet slot 20, the sensor-controlled electronics initiate the rotation of the metering shaft 44 into the rest position, the adhesive supply to the outlet slot 20 is interrupted.

The pressure loss occurring in the adhesive reservoir 50 by the output of adhesive is compensated automatically as the plunger 58 is pushed correspondingly deeper into the adhesive reservoir 50. The pressure in the adhesive reservoir 50 is determined by the cross-sectional ratio of the pressure cylinder 56 to the plunger 58 and the pressure in a preliminary chamber 64 of the accumulator 54. The pressure in this preliminary chamber is for example in the range from 0.7 to 0.8 bar.

Evidently, the binding process for the stacked printed products 10 can also be manual or semi-automatic.

A basic design principle of an adhesive application station 14 is shown in FIGS. 3 to 5. The functional division into application head 12, adhesive reservoir 50 (pressure chamber) and accumulator 54 is evident. The substantial individual elements of the application head 12 are shown individually in FIGS. 6 to 15.

The application head 12 comprises as a carrier a nozzle block 18 formed as a profile or milled or bored from a solid block.

At one end on the nozzle block 18 is attached a fixed stop 22 with the first side guide surface 24. This fixed stop can be positioned within the limits of a short slot 66 without fine adjustment.

A retainer 26 can be positioned over the area of a substantially larger slot 68. On the end of the retainer 26 is formed the second side guide surface 28. On the face of the nozzle block 18 opposite the fixed stop 22 is screwed a guide block 72 which for precise positioning of the retainer 26 holds an adjustment screw 74. This adjustment screw 74 comprises a knurled nut 76 with an adjustment scale 78 which can be structured as a vernier scale. Naturally, further variants of the retainer 26 not shown can be automatically positionable with other means known in themselves, for example a linear motor, stepper motor, hydraulic or pneumatic means.

In a corresponding bore of the nozzle block 18 is a metering shaft 44, which with the outlet slot 20 forms the slot nozzle 42 and which can be activated manually or mechanically automated by way of a swivellable lever 80.

The application head 12 is screwed and sealed directly to a separate adhesive reservoir 50 formed as a pressure chamber. A filler nozzle 82 for the adhesive reservoir 50 has an external thread and can therefore be connected directly with an interchangeable larger adhesive reservoir, for example a barrel pump. This guarantees absolute air-tight seal of the adhesive. The prevention of contact of the adhesive with air, which is the aim of the invention, is achieved.

The accumulator 54 is connected with the adhesive reservoir 50 by way of four spacer pipes 84. FIG. 4 shows a bore 86 for compressed air which comprises the usual connection fittings not shown. The pressure medium is guided into a preliminary chamber (64 in FIG. 2) and acts on a pressure cylinder 56 shown in dotted lines which transfers the pressure amplified surface-proportional by way of a plunger 58 to the adhesive reservoir 50.

FIG. 6 shows an application head 12 in top view, corresponding substantially—although side-inverted—to FIG. 3. For the sake of clarity in particular the fixing bolts for the fixed stop 22 and the retainer 26 are omitted, only the bores 88, 90 for bolts are shown in the slots 66, 68.

The nozzle block 18 according to FIG. 6 in the longitudinal direction not only has the adhesive outlet slot 20 but also linear guide elements. The slip surface 16 is angled slightly downwards along an edge 92 and thus forms an angled introduction ramp 62 for easier introduction of the stacked printed products. A first step 94 which is scarcely perceptible and a larger step 96 also serve for simpler fixing of the retainer 26, the fixed stop 22 and the guide block 72.

The width g of the slip surface 16 is set practically to the maximum possible value. It could be enlarged slightly by moving the fixed stop 22. The minimum width g of the slip surface 16 is limited by the length of the slots 66 and in particular 68.

In the retainer 26 can be seen a threaded rod 98. With this the spring force of the slide 32 guided by retainer 26 (FIG. 1) can be set.

FIG. 7 shows a nozzle block 18 without additional elements. It substantially corresponds to FIG. 6. However there is no first step 94 as a guide element. This guarantees a better slip surface 16. The bore 100 with internal thread serves to hold a fixing screw for the guide block 72.

The side view of FIG. 6 (from the right) shown in FIG. 8 shows the end of the nozzle block 18 hatched. Below the guide block 72 with the knurled nut 76 can be seen part of the adjustment plate 70 and, at the bottom, part of the retainer 26.

In the reinforced face of the nozzle block 18 can be seen the swivel-mounted metering shaft 44, its swivel lever (80 in FIG. 4) has been omitted for sake of clarity.

Also, in the nozzle block 18 is held a heating cartridge 102 and a temperature sensor 104 which serve to set the correct adhesive temperature in the application head 12.

In a recess 106 can be laid electrical cables, distributors or similar electrical components.

A retainer 26 with an integrated slide 32 is shown in FIGS. 10, 11 and 12. FIG. 10 shows the slide 32 projecting by around 0.4 mm with the third side guide 36 which according to FIG. 1 is angled away slightly to form the third deflector 36*a*. The slide 32 can be pressed into the retainer 26 against the resistance of a coil spring 106 until the second guide surface 28 runs flush with the third guide surface 36. The stroke restriction of the slide 32 is as stated ensured by the bolt 40 in the bore 38. The retainer 26 has a longitudinal through-bore 108 which creates clearance for the adjustment screw 70.

FIG. 11 shows the second guide surface 28 of the retainer 26. The second guide surface 28 is angled away slightly about an edge 110 to form the deflector 26*a*, together with the deflector 24*a* of the first guide surface 24 of the fixed stop 22 (FIG. 9) this therefore gives a wider insertion opening for the stacked printed products. The slide 32 or its third guide surface 36 is also angled away about a displaced edge 112. For better guidance in the retainer 26 the slide 32 has a flat shallow longitudinal groove 114.

As shown in FIG. 12, the slide 32 has a bore 116 with internal thread in which are pressed a coil spring 116 and a corresponding ball 118. The spring can be pretensioned using a setscrew 98.

FIGS. 13 and 14 show an adjustment screw 74 with knurled nut 76 and divisions 78 and the associated guide block 72 with a corresponding bore 120 with internal thread. A shaft lock 122 is also shown.

A metering shaft 44 shown in FIG. 15 is equipped at one end with a shaft lock 122 and at the other end is mounted a swivel lever 80 for manual or mechanical application of torque. A socket-head bolt 126 which is secured with its tip in a tapered recess of the metering shaft 44 prevents idle rotation of the lever 80.

In the left-hand area of the metering shaft is cut a linear groove which corresponds in function to a diagonal slot 46

(FIG. 2). A radial channel 124 is also provided which ensures the supply of adhesive when the metering shaft is in the working position.

What is claimed is:

1. Adhesive application station (14) for binding stacked printed products (10) by means of liquefiable adhesive (52) comprising an adhesive reservoir (50) formed as a pressure chamber, means for generating a pressure in the adhesive reservoir (50), a stationary application head (12) with a slip surface (16), along which spines of stacked printed products (10) can slide, and are guided by a first side stop (22) with a side guide surface (24, 24*a*) arranged on a first side of the slip surface (16) and guided by at least one second side stop (32) with a side guide surface (36) arranged on a second side of the slip surface (16), an outlet slot (20) of a slot nozzle (42) extending from the first to the second side of the slip surface (16), wherein, in order to automatically compensate for different thicknesses (d) of the stacked printed products (10), said at least one second side stop (32) is resilient in the direction of the outlet slot (20) within a tolerance range (t) of the stacked printed products (10) thereby lying tightly sealing on a covered portion of the outlet slot (20).

2. Adhesive application station (14) according to claim 1, wherein the tolerance range (t) is up to around ±1 mm, preferably around ±0.5 mm.

3. Adhesive application station (14) according to claim 1, wherein the first side stop (22) and the second resilient side stop (26 or 32) with the side guide surfaces (24, 28, 36) tapering in the introduction direction (E) of the stacked printed products (10).

4. Adhesive application station (14) according to claim 1, wherein the second resilient side stop (26 or 32) comprises a carriage guided mechanically or pneumatically as a whole on a nozzle block (18), a roller guided in a positionable holder, a slide (32) guided in a positionable retainer (26) or a leaf spring guided in a positionable holder.

5. Adhesive application station (14) according claim 4, wherein the second resilient side stop is returnably movable with preferably adjustable spring force or pneumatically.

6. Adhesive application station (14) according to claim 1, wherein the outlet slot (20) has an adjustable width(s).

7. Adhesive application station (14) according to claim 1, wherein the slot nozzle (42) comprises a manually or mechanically controlled rotatable metering shaft (44) directly below the outlet slot (20) with a longitudinal slot (46) which extends over the entire length of the outlet slot (20) and in the working position of the metering shaft (44) connects the outlet slot (20) with the directly-connected adhesive reservoir (50).

8. Adhesive application station (14) according to claim 7, wherein an integral accumulator (54) is formed with means acting on the adhesive reservoir (50) arranged directly in or below the application head (12) and thus guarantees automatic pressure compensation after every adhesive discharge.

9. Adhesive application station (14) according to claim 8, wherein a pressure cylinder (56) acts by means of the accumulator (54) by way of a plunger (58) directly on the adhesive (52) in the adhesive reservoir (50).

10. Adhesive application station (14) according to claim 1, wherein at least one sensor-controlled heating cartridge (102) is arranged in one of the application head (12) and the adhesive reservoir (50).

* * * * *